US009668072B2

(12) United States Patent
Hutt

(10) Patent No.: US 9,668,072 B2
(45) Date of Patent: May 30, 2017

(54) LOUDSPEAKER RECTIFICATION METHOD

(76) Inventor: Steven W. Hutt, Bloomington, IN (US)

( * ) Notice: Subject to any disclaimer, the term of this patent is extended or adjusted under 35 U.S.C. 154(b) by 525 days.

(21) Appl. No.: 12/833,885

(22) Filed: Jul. 9, 2010

(65) Prior Publication Data

US 2011/0211705 A1 Sep. 1, 2011

Related U.S. Application Data

(60) Provisional application No. 61/224,858, filed on Jul. 11, 2009.

(51) Int. Cl.
*H04R 29/00* (2006.01)

(52) U.S. Cl.
CPC ..... *H04R 29/00* (2013.01)

(58) Field of Classification Search
CPC ..... H04R 29/001; H04R 3/007; H04R 5/04
USPC ..... 381/56, 58, 59, 60, 86; 700/94
See application file for complete search history.

(56) References Cited

U.S. PATENT DOCUMENTS 5,361,305 A * 11/1994 Easley ..... H04B 1/082 381/58
5,581,621 A * 12/1996 Koyama et al. ..... 381/103
6,957,134 B2 * 10/2005 Ramseyer ..... H04R 29/001 381/58
7,092,536 B1 * 8/2006 Hutt ..... H04R 3/04 381/103
2007/0025559 A1 * 2/2007 Mihelich ..... H04S 7/307 381/59

OTHER PUBLICATIONS

Loudspeaker Production testing using the Techron TEF System 20 TDS Analyser and Host PC, Donald Shwing and Don B. Keele Jr., Ekhart Indiana, 11 AES meeting, 1992.*
Donald Sching, Loudspeaker Production testing using the Techron TEF system 20TDS Analyser and Host PC, Techron Div. Crown International Inc., AES 11th International Conference.*
Donald Schwing , Loudspeaker Production Testing Using the Techron TEF System 20TDS Analyser and Host PC, Techron Div. Crown International Inc., AES 11th International Conference.*
Hutt/Fincham, "Loudspeaker Production Variance", AES preprint #7530.
Fincham, "Production Testing of Loudspeakers Using Digital Techniques", AES preprint #1485.

* cited by examiner

*Primary Examiner* — Vivian Chin
*Assistant Examiner* — Ammar Hamid

(57) ABSTRACT

Loudspeaker drivers used in audio systems are subject to performance variance caused by production deviation of components and assembly processes and consequently audio system performance is influenced by the mechanical attributes of individual loudspeaker drivers of which the audio systems are comprised. This invention provides a solution to minimize the variance of duplicate audio system performance by rectifying the signal processing to minimize loudspeaker variance in duplicated or mass production audio systems.

21 Claims, 10 Drawing Sheets

FIGURRE 13
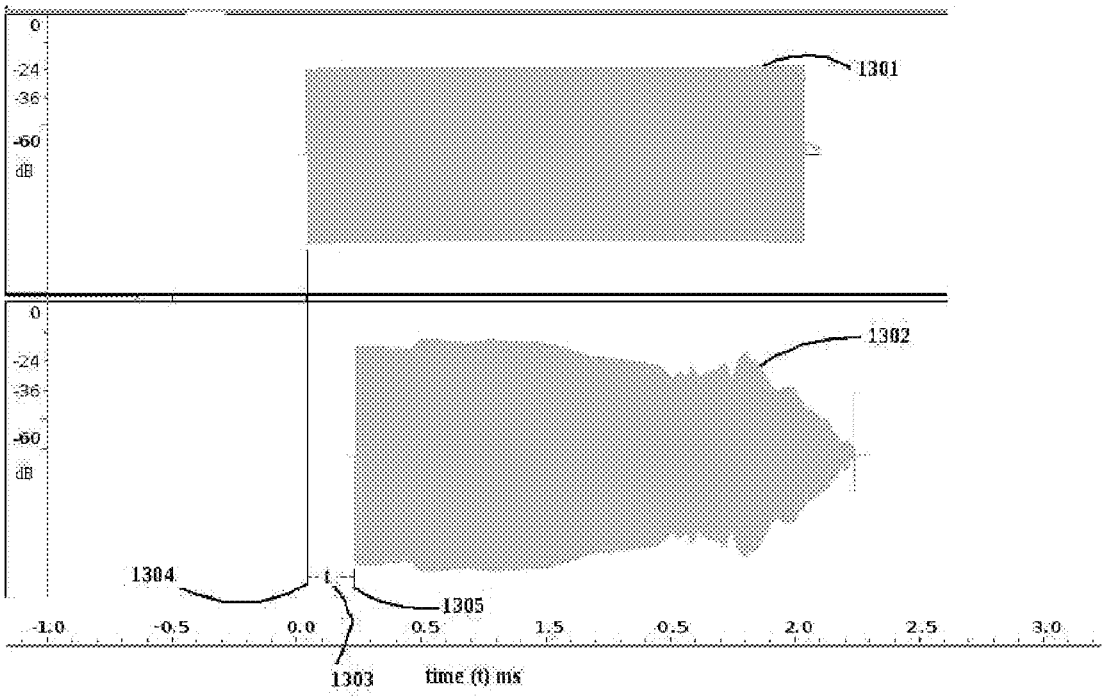
FIGURE 14
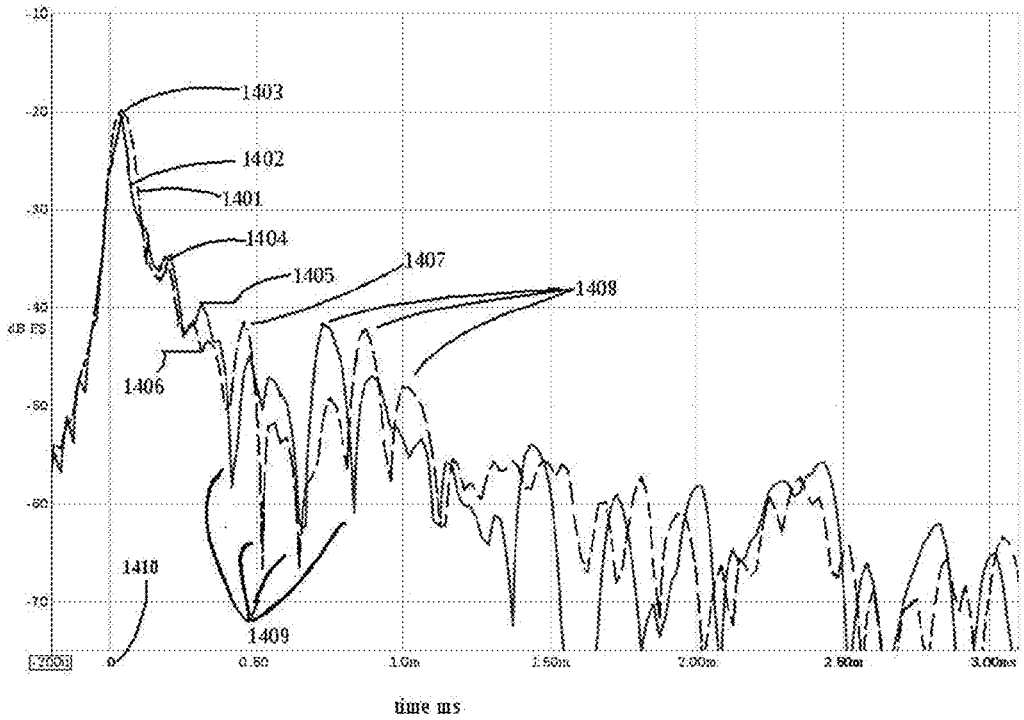

LOUDSPEAKER RECTIFICATION METHOD

PRIORITY CLAIM

This application claims the benefit of U.S. Provisional Patent Application Ser. No. 61/224,858 filed 11 Jul. 2009, which is expressly incorporated herein in its entirety by reference thereto.

TECHNICAL FIELD

The present application is in the technical field of audio systems. In particularly, the invention is in the field of measurement, analysis and rectification of loudspeakers used in production audio systems.

BACKGROUND OF THE INVENTION

Audio systems are assembled from a combination of loudspeakers and electronics and are traditionally designed through a development phase that may include computer modeling or simulation followed by development and assembly of a physical reference system that has undergone various iterations to optimize maximum acoustic performance within constraints such as physical size, materials and cost. To quantify the capability of an audio system to accurately reproduce sounds that will be played through it performance characteristics such as frequency response may be measured with acoustic measurement equipment. Along with loudspeakers and amplifiers an audio system often includes analog or digital signal processing that can modify the natural reproduction capabilities of loudspeakers and may be applied to individual channels in a stereo or multi-channel system such as left and right in a stereo system, or the signal processing may be applied to individual channels directly to full range or frequency divided loudspeakers such as a front left mid-range, front left high frequency tweeter and so on. When the reference audio system is finalized the designs for all components such as loudspeakers are finalized for production and the equalization data developed either manually or through an automated tuning process such as described in US patent application 20070025559 "Audio Tuning System" and may be stored in a master record so that it may be recalled for embedding into production audio systems.

For the acoustic performance of duplicate audio systems such as in mass produced audio systems to closely conform to the acoustic performance of the reference audio system on which it is based the individual loudspeakers should ideally conform within a metric threshold in comparison with the individual loudspeakers used in the reference system to which each loudspeaker is associated. By associated we mean for example the specific type or model of loudspeaker and its installation location in the audio system. For example, a 16 cm loudspeaker where the model information includes all mechanical details of the subcomponents such as cone, spider and voice-coil and so on and their assembly processes is mounted in the front left door of a vehicle audio system. However in actuality performance of mass produced loudspeakers can deviate substantially as described in Audio Engineering Society (AES) Preprint #7530 "Loudspeaker Production Variance". Consequently variance of individual duplicate production loudspeakers causes performance of duplicate production audio systems to vary from each other and in particular perform differently than the reference audio system. It would be preferable to minimize the physical variance of duplicate production loudspeakers but the required material and assembly process control will add complexity and cost to production loudspeakers. Alternatively sorting loudspeakers into performance categories based on minimal metrics threshold tolerances for grouping similar performance loudspeakers for installation into specific consumer loudspeaker systems as described in AES preprint #1485 "Production Testing of Loudspeakers Using Digital Techniques" adds complexity and cost that is not unpractical for high volume duplicate mass production audio systems and in particular for mass produced audio systems installed in vehicles.

Loudspeakers are traditionally described as operating within various electro-mechanical and acoustic metric thresholds. Some examples of metric thresholds include a frequency response that usually defines a performance bandwidth and deviation within the bandwidth, sensitivity relative to a distance and power input, voice-coil DC resistance, impedance, harmonic or total harmonic distortion, intermodulation distortion and parameters that describe the interaction of mechanical and electrical components. In addition to loudspeaker production variance loudspeakers are also prone to influences of environmental ambient conditions such as ambient temperature and ambient relative humidity as described in AES preprint 5507 "Ambient Temperature Influences on OEM Automotive Loudspeakers" and U.S. Pat. No. 7,092,536 to Hutt et al. In order to minimize measurement error it is important that ambient conditions be within a reasonable tolerance threshold for loudspeakers to be reliably and repeatably measured.

U.S. Pat. No. 5,581,621 to Yoshihide et al describes use of a programmable parametric equalizer to automatically adjust an audio system but provides no means for controlling the process to reliably or repeatably correlate results of one operation to another operation or to reliably repeat and correlate to a performance response target based on previously measured reference data. U.S. Pat. No. 5,361,305 by Easley et al describes a vehicle audio test system that utilizes radio transmission to test audio system operation but provides no means to make adjustments to the audio system to rectify loudspeaker production variance nor does it provide a means to reliably and repeatably reproduce test results.

Therefore there exists a need for a method to reliably and repeatably identify and rectify the influences of loudspeaker production variance on audio systems.

OBJECTIVES AND SUMMARY OF THE INVENTION

It is the objective of the invention to provide a method to rectify the acoustical performance characteristics of individual loudspeakers used in duplicate or mass production audio systems so that the they conform within a specified metrics threshold tolerance of the acoustical performance characteristics of associated loudspeakers in the reference audio system on which the duplicate or mass produced audio system is based. By associated loudspeakers we mean for example the specific type or model of loudspeaker and its installation location in the audio system.

Audio systems typically include one or more loudspeakers where the type or model of each loudspeaker in the audio system and their mounting locations is known and in the case of production vehicles or architectural layouts such as movie theaters the boundary conditions are also know. By boundary conditions we mean any physical object in the sound field proximate to the loudspeakers in the audio system from which sound may be reflected or partially absorbed such as but not limited to video screens, recording mixing consoles, walls, floors, ceilings, doors, windows, furniture and in vehicles, windscreens, instrument panels, doors, floor and seats etc. When one or more microphones are placed in predetermined locations relative to loudspeakers and boundary conditions of a reference audio system the loudspeakers may be measured individually or collectively in any combination with a computer based audio measurement system that may be embedded in the audio system or in associated hardware such as a vehicle diagnostic computer or in an external device such as a stand alone computer to acquire performance data metrics and metrics threshold tolerances can be specified for each loudspeaker in the audio system. Many audio systems employ a plurality of loudspeakers but individual loudspeakers may be made active for the measurement process by muting all loudspeakers in the system except for the specific loudspeaker to be measured. The performance data metrics acquired during the measurement process will be stored with their specified data metrics threshold tolerances for comparison to the associated loudspeakers in duplicate audio systems where the performance data metrics of the loudspeakers in the duplicate audio system are measured in the same method with same boundary conditions. If loudspeakers performance data metrics in a duplicate audio system do not conform within the specified performance data metrics threshold tolerances additional or modified signal processing may be applied to the signal processing chain and be stored in the signal processing memory so that the loudspeakers performance data metrics in the duplicate audio system are rectified to conform within the specified performance data metrics threshold tolerances. The signal processing required for rectification may be applied directly to the signal processing memory by making manual or automated changes either directly or via a vehicle communication bus or may be applied by an equalization tool external to the duplicate audio system. When performance data metrics for all loudspeakers in the audio system have been rectified as necessary to conform within the specified metrics threshold tolerances the rectified signal processing data is stored in an updated signal processing record in the signal processing memory of the duplicate audio system or an equalization tool external to the duplicate audio system.

BRIEF DESCRIPTION OF TILE DRAWINGS

The invention can be better understood with reference to the following drawings and description. The components in the figures are not necessarily to scale, emphasis instead being placed upon illustrating the principles of the invention.

FIG. 13 illustrates example wave forms used in the rectification acquisition process.

FIG. 14 illustrates a comparison of impulse response graphs with different boundary conditions.

DETAILED DESCRIPTION OF THE PREFERRED EMBODIMENTS

Figure 1:
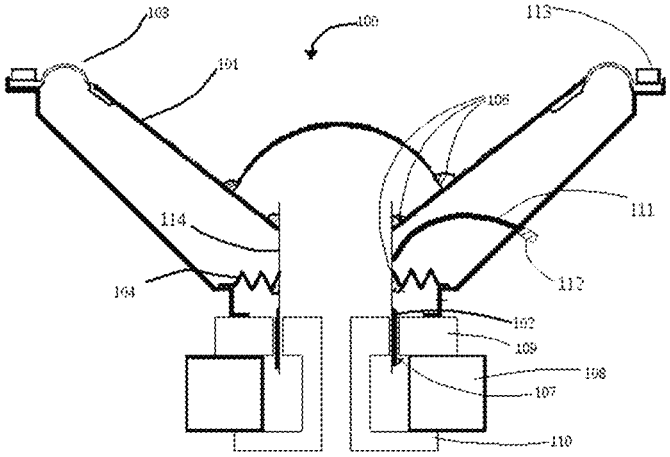
FIG. 1 is a cross-section illustration of an example loudspeaker depicting the individual loudspeaker components.

The invention will be understood by one skilled in the art of transducer design and manufacturing and in particular how production variance in manufactured loudspeakers influences the sound of duplicate audio systems. FIG. 1 illustrates a cross-sectional drawing of a typical loudspeaker 100. The moving assembly that contributes to the moving mass is made up of the cone body 101, voice-coil assembly 102, suspension 103, spider 104, and adhesive 106. In addition to the mass and stiffness of the loudspeaker moving assembly performance is influenced by the flux density in the magnetic gap 107 determined by the magnetic energy stored in the magnet 108 and the geometry and material of the top plate 109 and T-yolk 110. Voice-coil resistance is determined by the cross-sectional area of the wire and total length of wire in the voice-coil as determined by the number of turns and voice-coil diameter. When an electrical signal is applied to the voice-coil the voice-coil and magnetic flux combine for an electro-motive force BL where B=magnetic flux and L=length of wire in the magnetic field. Litz wire 111 carries current from the terminal 112 that receives power from an amplifier, not shown. Gasket 113 affects performance by influencing frequencies relative to dimensional geometry or how the loudspeaker is affixed to a baffle and is known as a manufacturing cause of failure in incidents where the gasket is misapplied or missing in production.

Figure 2:
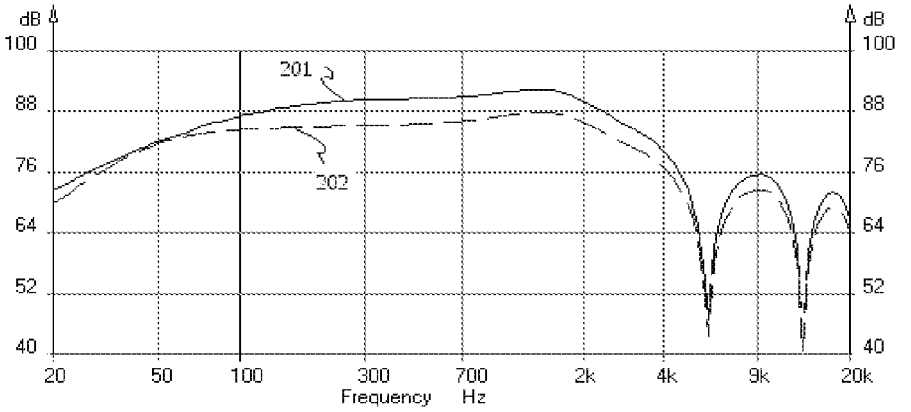
FIG. 2 illustrates the frequency response variance of two samples of the same type and model of loudspeaker assembled from components that produce a maximum opposite influence on performance.

FIG. 2 illustrates the frequency response of two samples of the same type and model of loudspeaker that are assembled with components from the minimum and maximum allowable component metrics threshold tolerance as depicted in Table 1. The frequency response 201 is derived from a loudspeaker assembled with components at the range of metrics threshold tolerance allowing for maximum acoustic output for a given voltage input; minimum moving mass, minimum voice-coil resistance and maximum BL. The frequency response 202 is derived from a loudspeaker assembled with components at the range of metrics threshold tolerance allowing for minimum acoustic output for a given voltage input, maximum moving mass, maximum voice-coil resistance and minimum BL. FIG. 2 illustrates that there can be considerable difference between two loudspeakers that are supposedly the same type of loudspeaker and where either one could be used in any audio system for which it is specified.

TABLE 1

| Loudspeaker Components Production Tolerance | |
|---|---|
| Cone Body Mass | +/−10% |
| Suspension Stiffness | +/−15% |
| Spider Stiffness | +/−15% |
| Voice-Coil Mass | +/−10% |
| Voice-Coil $R_E$ | +/−10% |
| Magnetic Gap Flux Density β | +/−5% |
| Adhesive Mass-Moving Assy. | +/−15% |

Figure 3:
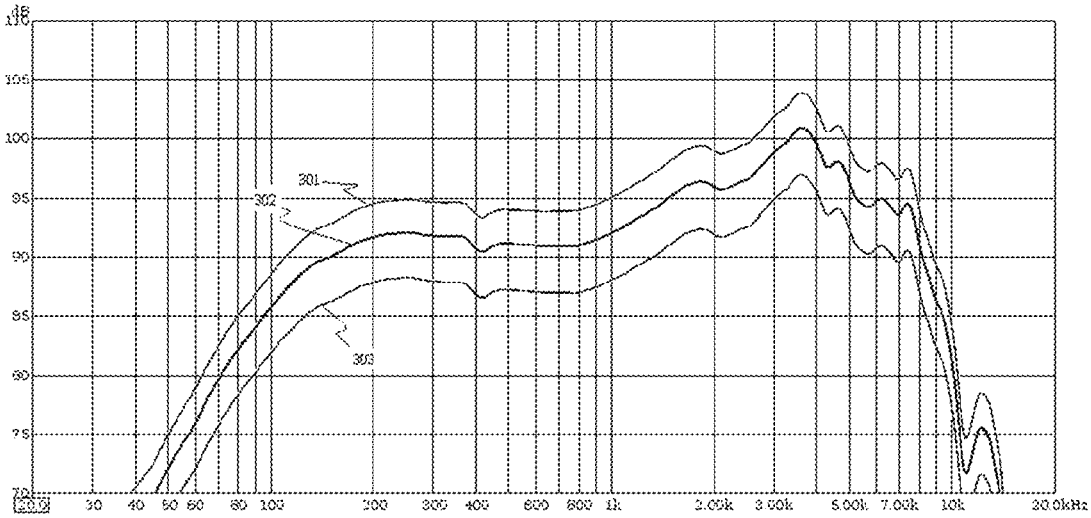
FIG. 3 illustrates the minimum, median and maximum frequency response metrics threshold tolerance deviation of a typical loudspeaker production specification.

FIG. 3 illustrates a frequency response graph with example response curves from a production run of a specific type and model of loudspeakers. Frequency response deviation in the same type and model of production loudspeakers is caused by the variance in the materials and manufacturing process of the individual components in addition to geometric alignment of components and process variations during the loudspeaker assembly process. FIG. 3 illustrates typical acceptable metrics threshold tolerance of frequency response curves for maximum metrics threshold tolerance deviation 301, median average 302, and minimum acceptable metrics threshold tolerance deviation 303.

Figure 4:
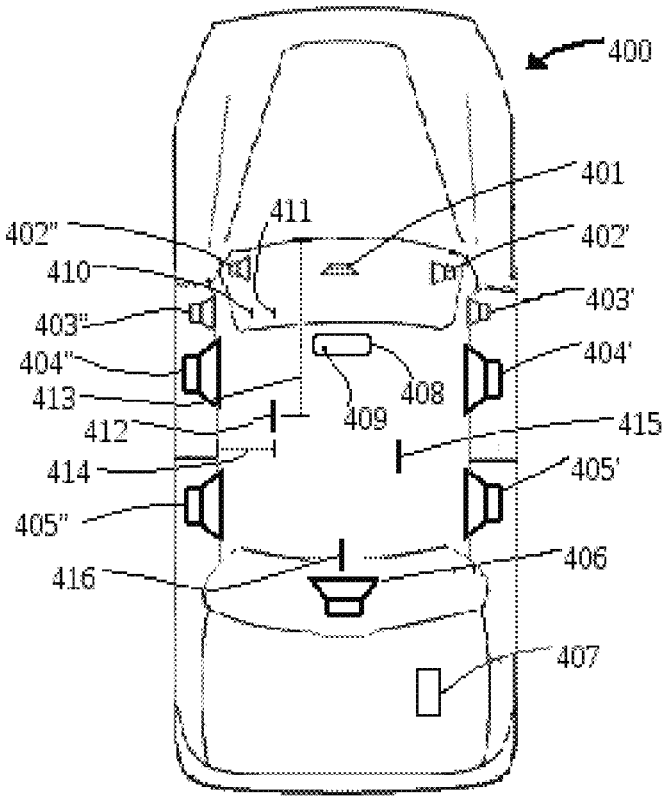
FIG. 4 illustrates a typical vehicle audio system architecture.

Referring to FIG. 4 components in a typical vehicle audio system architecture are illustrated in an automobile audio system schematic. It should be noted that the audio system architecture in FIG. 4 is for illustration purposes only and should not be construed as a limitation to vehicle audio system architecture that may utilize the present invention. In the example audio system architecture each of the loudspeakers Center Channel loudspeaker 401, Right Front Mid loudspeaker 402', Left Front Mid loudspeaker 402", Right High Frequency loudspeaker 403', Left High Frequency loudspeaker 403", Right Mid-Bass Door loudspeaker 404', Left Mid-Bass Door loudspeaker 404", Right Rear Door loudspeaker 405', Left Rear Door loudspeaker 405" and Sub-Woofer loudspeaker 406 would be connected to amplifier 407 or head-unit 408 or combination thereof. Signal processors and memory elements would be installed in the amplifier 407 or head-unit 408. A telephony microphone 409 may be placed directly in a head-unit 409 or in a location remote from the head-unit as described in FIG. 6. Preferably a thermal sensor 410 and humidity sensor 411 should be located within the vehicle to monitor acquire ambient temperature and humidity data during the acoustic acquisition process since ambient atmospheric conditions can influence the propagation of sound. Ideally the ambient condition data is acquired by either by the vehicle sensors or external sensors and are stored in the measurement setup information. One or more test acquisition microphones 412 may be installed in the vehicle temporarily during testing and microphone's location coordinates should be measured from fixed boundaries 413, 414 and the microphone's test location coordinates stored in the measurement setup information. Alternate acquisition microphone example locations are illustrated 415 and 416. FIG. 4 is provided as an example illustration only as production vehicles may place loudspeakers in similar or different locations, may use more or less loudspeakers and may use different size or frequency range loudspeakers and may or may not include an external amplifier with DSP in addition to a head-unit. However once an audio system design is committed for mass production, that design and implementation remains in effect until a design change is executed along with a document control process that accounts for all changes in effect creating a new audio system where a new verification and rectification process would be required.

Figure 5:
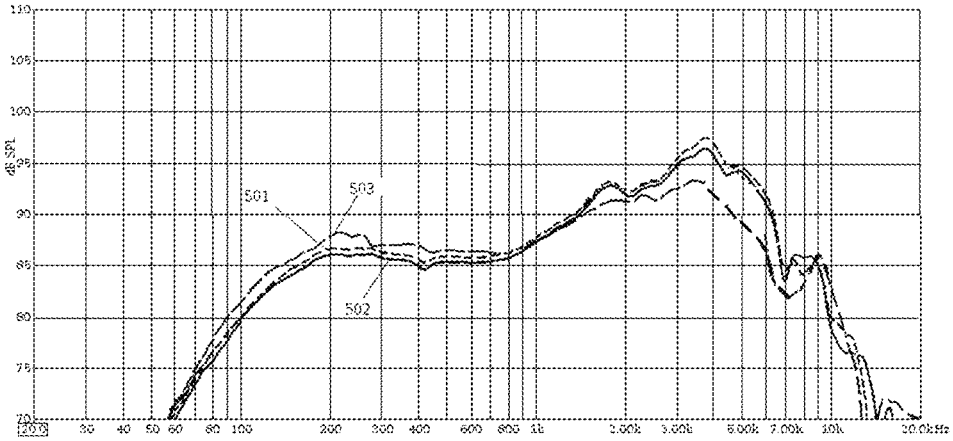
FIG. 5 illustrates performance response characteristics of the same audio system with variations caused by repositioning the acquisition microphone location for each acquisition.

FIG. 5 illustrates the variation of frequency response performance that is caused by acquiring measurement data of a specific loudspeaker in a specific vehicle audio system with the microphone in different locations where FIG. 5 response curve 501 correlates to FIG. 4 microphone location 412, FIG. 5 response curve 502 correlates to FIG. 4 microphone location 411 and FIG. 5 response curve 503 correlates to FIG. 4 microphone location 412. The performance variations as illustrated in FIG. 5 are not caused by audio system or loudspeaker performance variation but are caused only due to the measurement process where different microphone locations were used for each of the response curves 501, 502 and 503.

Figure 6A:
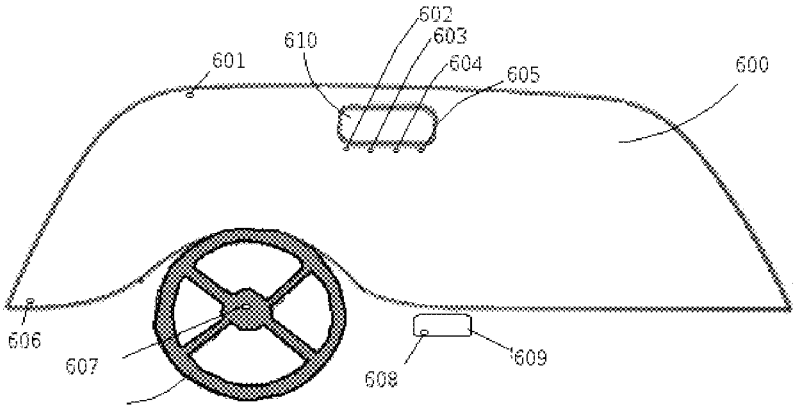
FIG. 6A illustrates various example locations for vehicle communications microphones.

Referring to FIG. 6A various locations are illustrated for vehicle communications microphones that could be used for voice-commands, telephony, ambient noise acquisition or other. Microphone 601 at top left of windshield 600 near the headliner (not shown) junction, 602 microphone attached to rear-view mirror 610 or included with 603, 604, 605 in a microphone array attached to the rear-view mirror 610, microphone 606 at base of windshield near the driver, microphone 607 in center of steering wheel 611 microphone 608 in head-unit 609 are all typical locations that may be utilized for a vehicle microphone. The microphone locations illustrated in FIG. 6 would not usually be installed in the same vehicle and are included to illustrate example locations only.

Figure 6B:
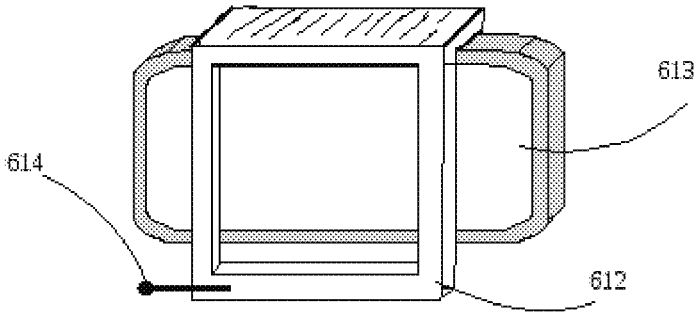
FIG. 6B illustrates an example microphone mounting fixture.

Referring to FIG. 6B an example microphone mounting fixture 612 is illustrated that would in this case would attach to the rear-view mirror 613 in such a manner that it would support a test microphone 614 in specific location relative to boundary conditions. Mounting fixtures may be created in different embodiments custom developed for specific vehicles and may be attached to areas other than the rear view mirror.

Figure 7:
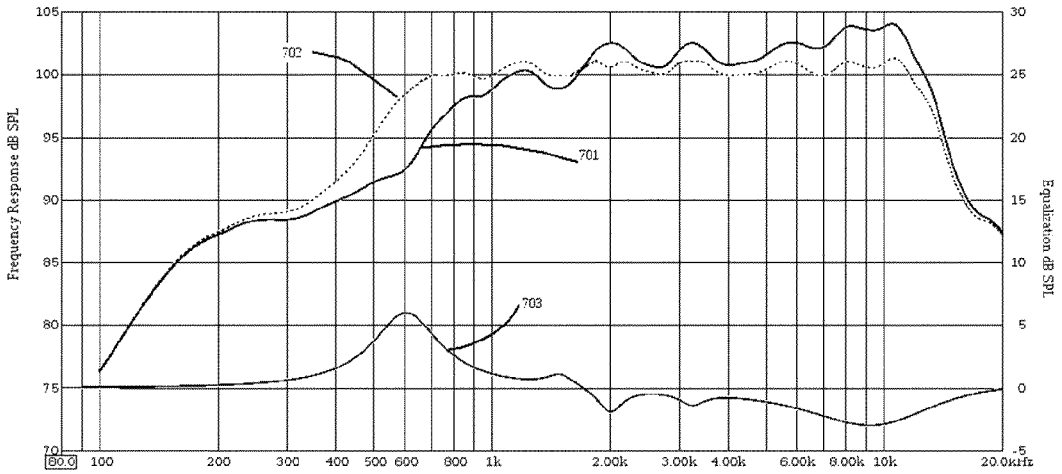
FIG. 7 illustrates unequalized frequency response measurement in comparison to the equalized response and the equalization curve.

Audio systems typically have electrical equalization applied as necessary to improve the overall acoustic performance. FIG. 7 is an illustration of the unequalized frequency response measurement 701 of Left Front Mid loudspeaker 402" as illustrated in FIG. 4 measured in situation in an example vehicle reference audio system. Applying equalization 703 to the electrical signal directed to loudspeaker 402" modifies the loudspeaker output to the frequency response measurement 702. Equalization curve 703 is stored in the reference audio system master reference record.

Figure 8:
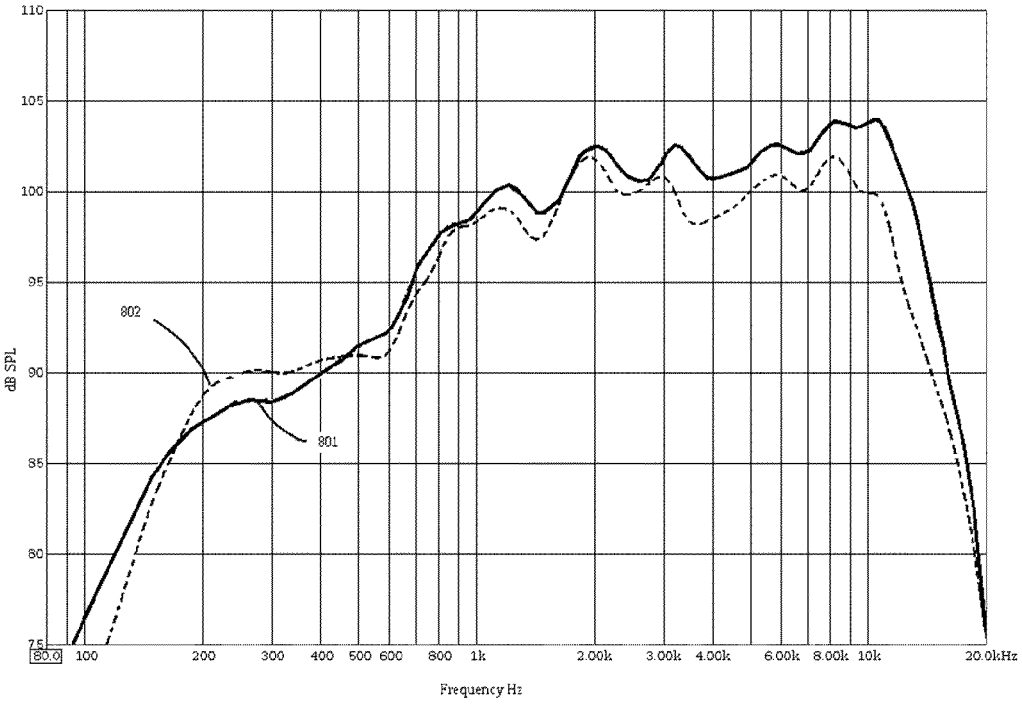
FIG. 8 illustrates the typical unequalized response of two similar loudspeakers from a production build.

Referring to FIG. 8 the unequalized frequency response measurement 701 (FIG. 7) of Left Front Mid loudspeaker 402" (FIG. 4) measured in situation in the example vehicle reference audio system is redrawn 801 for comparison to the unaltered frequency response measurement of a typical production loudspeaker measured in the production audio system as represented by curve 802. The frequency response difference between 801 and 802 is typical of production loudspeakers and is within allowable loudspeaker production metric thresholds tolerance as previously described.

Figure 9:
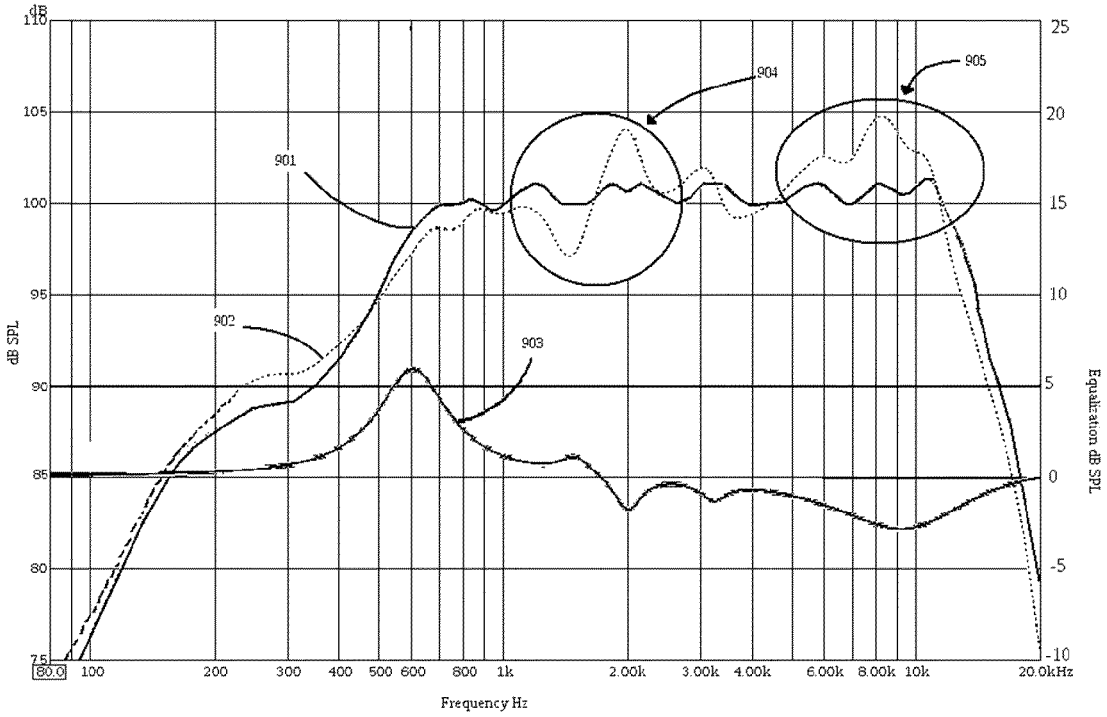
FIG. 9 illustrates the comparative results of applying the same equalization curve to two same type loudspeakers.

FIG. 9 illustrates the frequency response with the equalization from the master reference record applied to the production loudspeaker shown in the vehicle audio system of FIG. 8. Loudspeaker frequency response 901 illustrates the frequency response with equalization from the master reference record applied to 801 from the reference audio system and 902 illustrates the frequency response with the equalization from the master reference record applied to 802 from the production loudspeaker. The equalization curve from the master reference record is illustrated by 903. It can be seen that there is considerable deviation between the reference loudspeaker response curve 901 and duplicate production loudspeaker response curve 902 as illustrated by the zones illustrated in circles 904 and 905.

Figure 10:
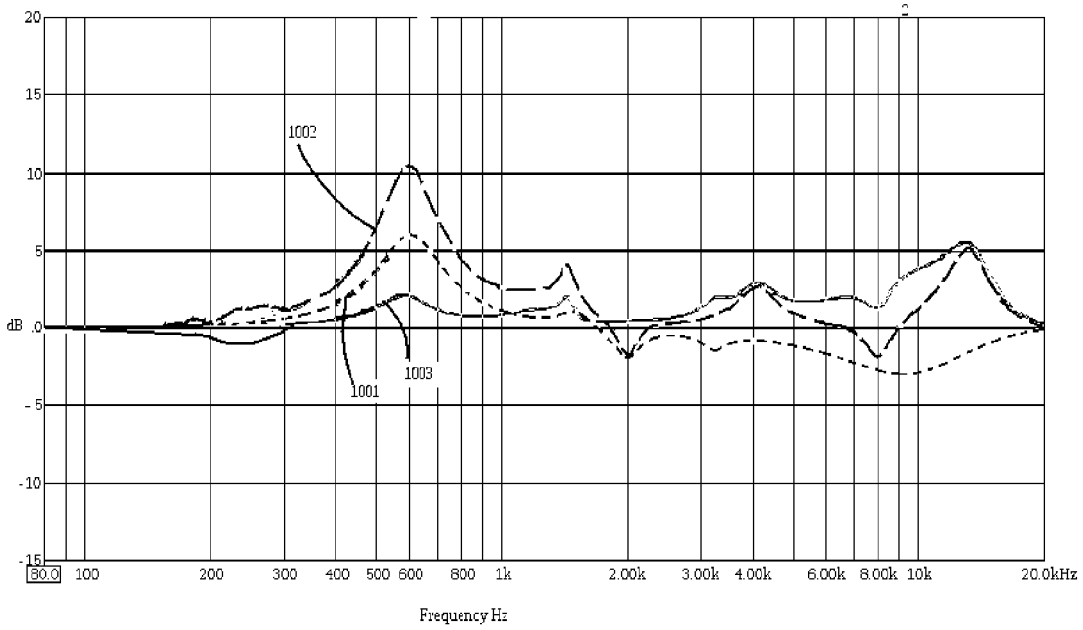
FIG. 10 illustrates an original equalization curve, a rectification curve and a curve representing the sum of the equalization plus rectification curves.

Referring to FIG. 10 the equalization from the master reference record curve 1001 as applied to 801 to result in 901 and applied to 802 to result in 902. Adding the difference between the frequency responses 901 and 902 to curve 1001 results in curve 1002 which is the rectification adjustment required to bring 902 into closer frequency response compliance with 901. Rectification curve 1003 is an example of how the rectification would be customized for any specific production loudspeaker so that the combined equalization and acoustic result would closely match the appropriate result from the reference audio system. The rectification process may be done manually or with an automated process to calculate the sum difference between reference target and production response measurements.

Figure 11:
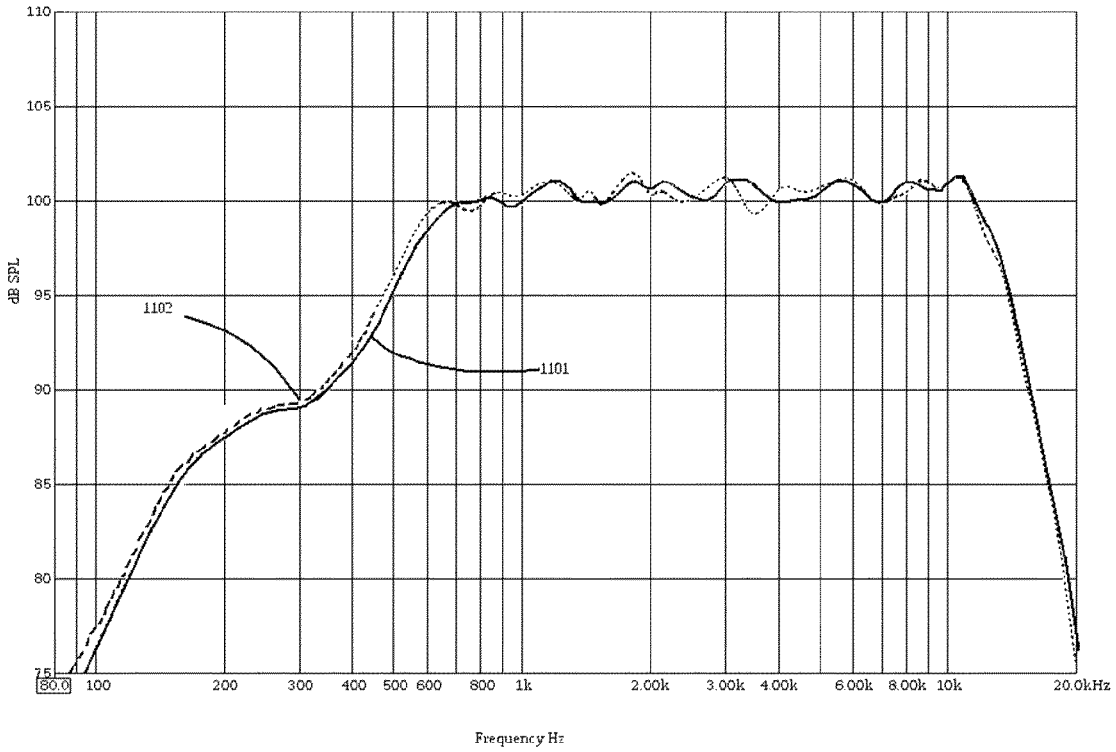
FIG. 11 illustrates the loudspeaker response comparison of applying the rectification curve with the equalization curve.

Referring to FIG. 11 it is shown that there is minimal difference between frequency response of the reference audio system loudspeaker with equalization from the master reference record 1101 and frequency response 1102 of the duplicate audio system with production loudspeaker to which the rectification curve 1003 is applied.

Figure 12A:
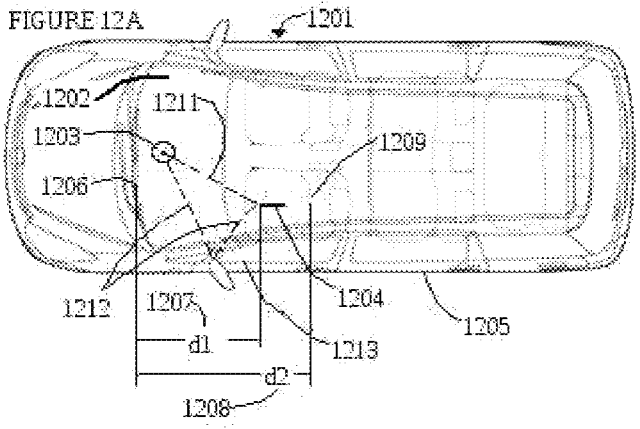
FIGS. 12A, 12B and 12C Illustrate the sound propagation path between an example loudspeaker and measurement microphone.
Figure 12B:
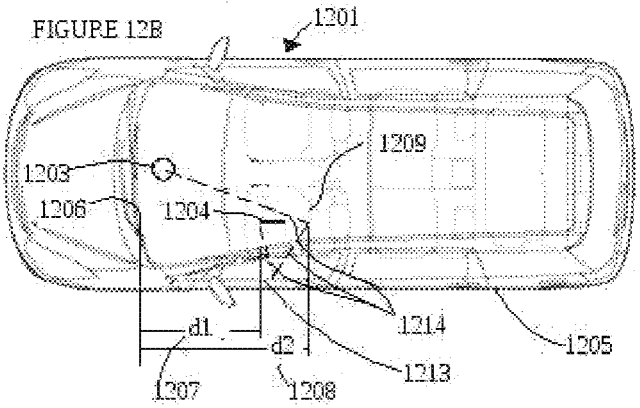
Figure 12C:
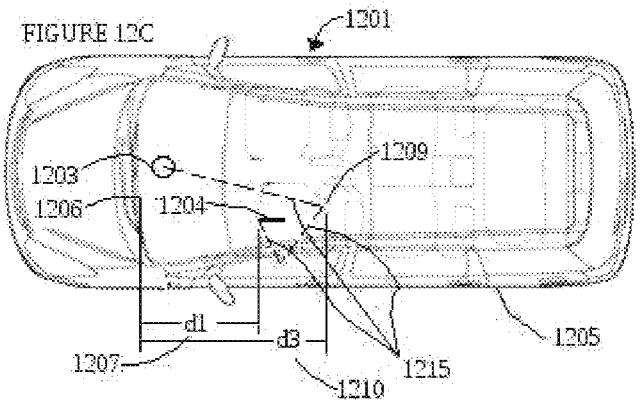

Referring to FIGS. 12A, 12B and FIG. 12C three plan views are illustrated of a vehicle 1201 as an example of how boundary conditions influence sound propagation. The illustration in FIG. 12 uses a vehicle as an acoustic environment but could also be exemplified by a traditional room such as in a home or a movie theater. Loudspeaker 1203, windshield 1202 and test acquisition microphone 1204 are illustrated in an example setup in that are each is located in a fixed position relative to the vehicle body 1205. In this example the lateral distance from base of windshield 1206 to microphone 1204 is indicated by dimension "d1" 1207 and is fixed at a constant distance for each of the example FIGS. 12A, 12B and 12C. Referring to FIGS. 12A and 12B the lateral distance from base of windshield 1206 to the back support of the driver seat 1209 is indicated by dimension "d2" 1208. Referring to FIG. 12A sound propagation paths between loudspeaker source 1203 and microphone 1204 are illustrated as direct path 1211, a first order reflection 1212 reflecting off driver side window 1213. Referring to FIG. 12B the sound propagation path between loudspeaker 1203 and microphone 1204 are illustrated by a second order reflection path 1214 where the sound first reflects off the back support of the driver seat 1209 then reflects off driver side window 1213 before arriving at the microphone 1204. Referring to FIG. 12C the lateral distance from base of windshield 1206 to the back support of the driver seat 1209 is indicated by dimension "d3" 1210 in figures and in this representation is a dimension greater than 1208. Based on the dimensional relationships as illustrated the sound propagation time is greater for sound propagation path 1212 than for sound propagation path 1211 and that sound propagation path 1214 is greater than sound propagation path 1212 and that sound propagation path 1215 is greater than sound propagation path 1214. It should be apparent that sound propagation path 1211 and first order reflection from the driver window 1213 as indicated by 1212 (FIG. 12A) will not change regardless of driver seat 1209 position. It should also be apparent that as the driver seat 1209 is moved rearward a greater distance from the base of the windshield 1206 that the second order reflection 1214 (FIG. 12B) and 1215 (FIG. 12C) from the back support of the driver seat 1209 will increase the sound propagation time for sound to travel from the loudspeaker 1203 to the microphone 1204.

Referring to FIG. 13 two waveforms are illustrated where abscissa is in the time domain and the ordinate is amplitude in dBv, 1301 being a signal output from the test source and 1302 being the output from a loudspeaker device under test (DUT) acquired through the test acquisition microphone. Ideally, waveform 1301 is acquired by electrical connection at the amplifier output or loudspeaker input terminals 112. By calculating the time (t) 1303 interval between the start of test waveform 1304 and the start of loudspeaker DUT waveform 1305 acquired through the test acquisition microphone the sound propagation time between the loudspeaker DUT and test acquisition microphone may be known. The propagation time for sound from each loudspeaker in the audio system to reach the acquisition microphone will be unique in any case that the acquisition microphone is located non-equidistant from any two loudspeakers in the audio system. Knowledge of the sound propagation time for each loudspeaker in the audio system provides a method to confirm that the appropriate loudspeaker is connected to the output channel from the amplifier and conversely that the microphone is in the expected location. An inversion of the acquired waveform from the loudspeaker DUT would indicate that the loudspeaker is connected out of polarity.

Referring to FIG. 14 two energy vs. time domain impulse response measurements dashed line 1401 and solid line 1402 are shown as representation of measurements acquired according to the boundary conditions setup as illustrated in FIGS. 12A, 12B where driver seat 1209 is in one position and 12C where driver seat 1209 is in a second more rearward position. First arrival peak 1403 illustrates the arrival at the microphone 1204 (FIG. 12) of sound most directly from loudspeaker source 1203 represented as sound propagation path 1211 and second peak 1404 is relative to sound propagation path 1212 and as can be seen both peaks are nearly identical for both measurements 1401 and 1402. Time 0 ms 1410 is analogous to start of waveform 1304 (FIG. 13). The third peak 1405 is related to reflection 1214 and is seen in measurement 1402 but is in fact a slight null 1406 in measurement 1401 because the third peak 1407 arrives slightly later in time due to the greater sound propagation path 1215 of the third order reflection caused by the greater distance 1210 between loudspeaker 1203 and driver seat 1209. Peaks 1408 and nulls 1409 are typical acoustical influences of other boundary reflections influenced by specific boundary conditions. It is clear that analysis and comparison of time response measurements will indicate physical differences in test setups such as but not limited to which loudspeakers are playing, microphone location relative to boundaries, boundary materials and boundary conditions for example such as seats or open or closed windows or doors.

Figure 15:
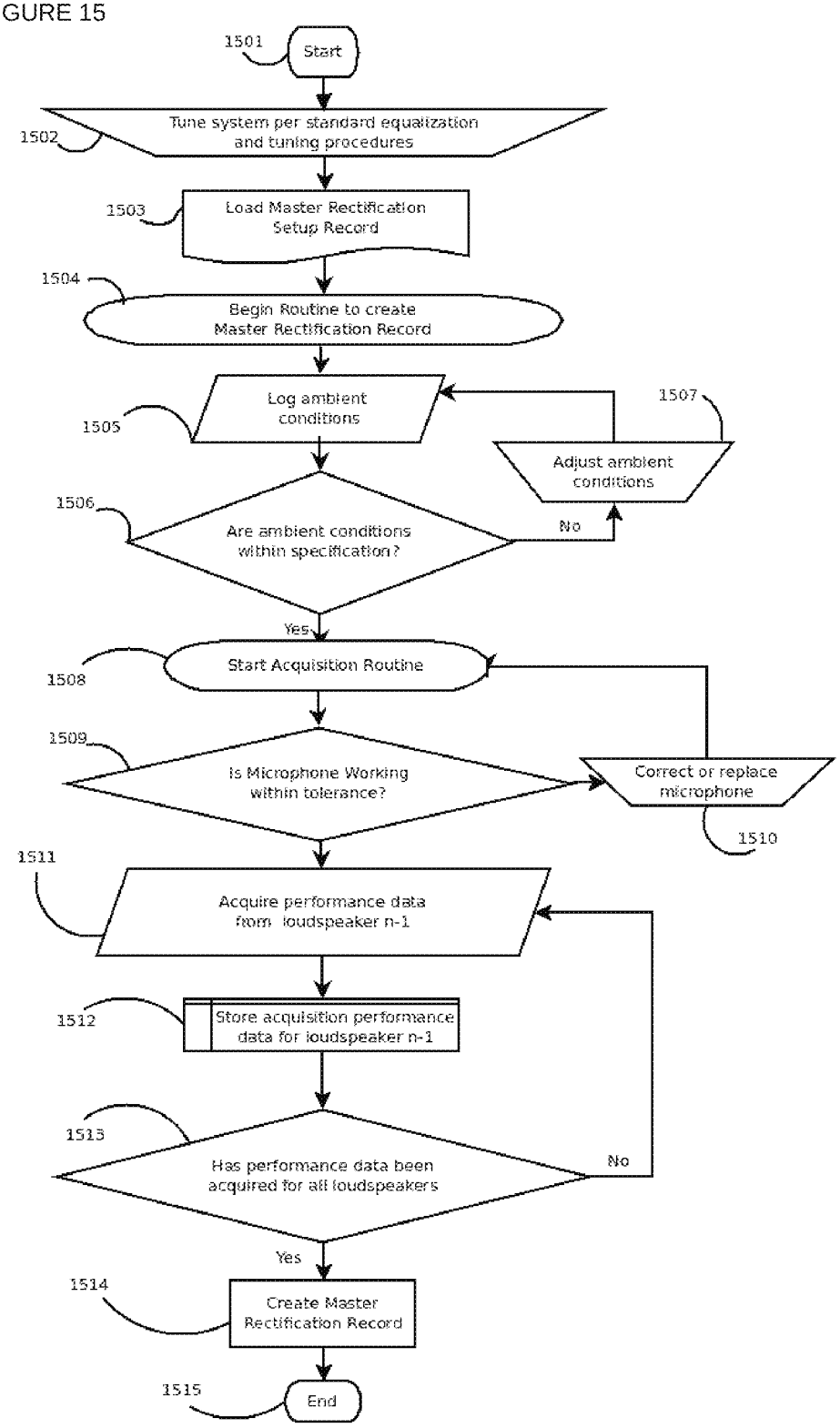
FIG. 15 illustrates the flow chart of the process to create the master reference record required to run the rectification process.

Referring to the flow chart in FIG. 15 the process to create a Master Rectification Record is illustrated. After the reference audio system has been fully developed and tuned per standard equalization and tuning procedures 1502 a Master Rectification Setup Record 1503 is defined for each audio system that includes but is not limited to ambient conditions that include temperature and relative humidity tolerance specification, microphone type and location relative to loudspeakers and boundaries, boundary conditions with furniture or equipment location or in the case of vehicles seat settings including forward/back position, seat-back upright angle position, seat upholstery, seat type, window settings preferably in closed position, doors closed, steering column in default position, armrests position documented preferably in upright position, storage locations documented preferably with covers closed (example; glove box), and in the case of vehicles should include VIN (vehicle information number) series and reference vehicle VIN if applicable. Also included should be the audio system build record with loudspeakers type and location, signal processing record with software version, crossovers, equalization, delay, limiters, amplifier information with model and version and specifications for allowable tolerance of ambient environmental conditions including temperature and relative humidity and allowable ambient noise conditions. The Master Rectification Setup Record 1503 should also include information about how the data acquisition was executed including the test signal type, individual loudspeaker test setups, bandwidth, acquisition signal voltage, method and hardware to store acquisition data and the analysis and rectification algorithms used to analyze conformance and to validate that the data acquisition is within the metric thresholds tolerance. After loading the Master Rectification Setup Record 1503 the routine to create the Master Rectification Record is begun 1504. Ambient environmental conditions including temperature and relative humidity should be recorded in a log 1505 and verified to be within specification 1506 as defined in the Master Rectification Setup Record 1503. If ambient environmental conditions are outside of the allowable specification tolerance ambient conditions should be adjusted 1507. Ambient noise conditions are measured by running the acquisition signal from the acquisition microphone with zero input for a nominal time period for example one second and if the ambient noise is determined to be too high the ambient noise should be reduced by changing ambient noise conditions. The acquisition routine is started 1508. The microphone should be verified to be working within metric thresholds tolerance 1509 and if the microphone is not working within metrics threshold tolerance it should be rectified or replaced 1510. During the acquisition routine performance data for the loudspeakers is acquired 1511 and the individual loudspeaker performance data is stored 1512 and will include the sound propagation time 1303 for the sound to arrive at the microphone from each loudspeakers. Loudspeaker acquisition data 1511 is cross referenced against the Master Rectification Setup Record 1503 to confirm data from all loudspeakers has been acquired 1513 otherwise the routine loops back to acquire performance data from the next loudspeaker 1511 until performance data has been acquired for all loudspeakers in the audio system and stored in memory 1512. The Master Rectification Record is then created 1514 and will include all information from the Master Rectification Setup Record 1503 in addition to all data acquisitions organized and stored 1512 before the process is terminated 1515.

Figure 16:
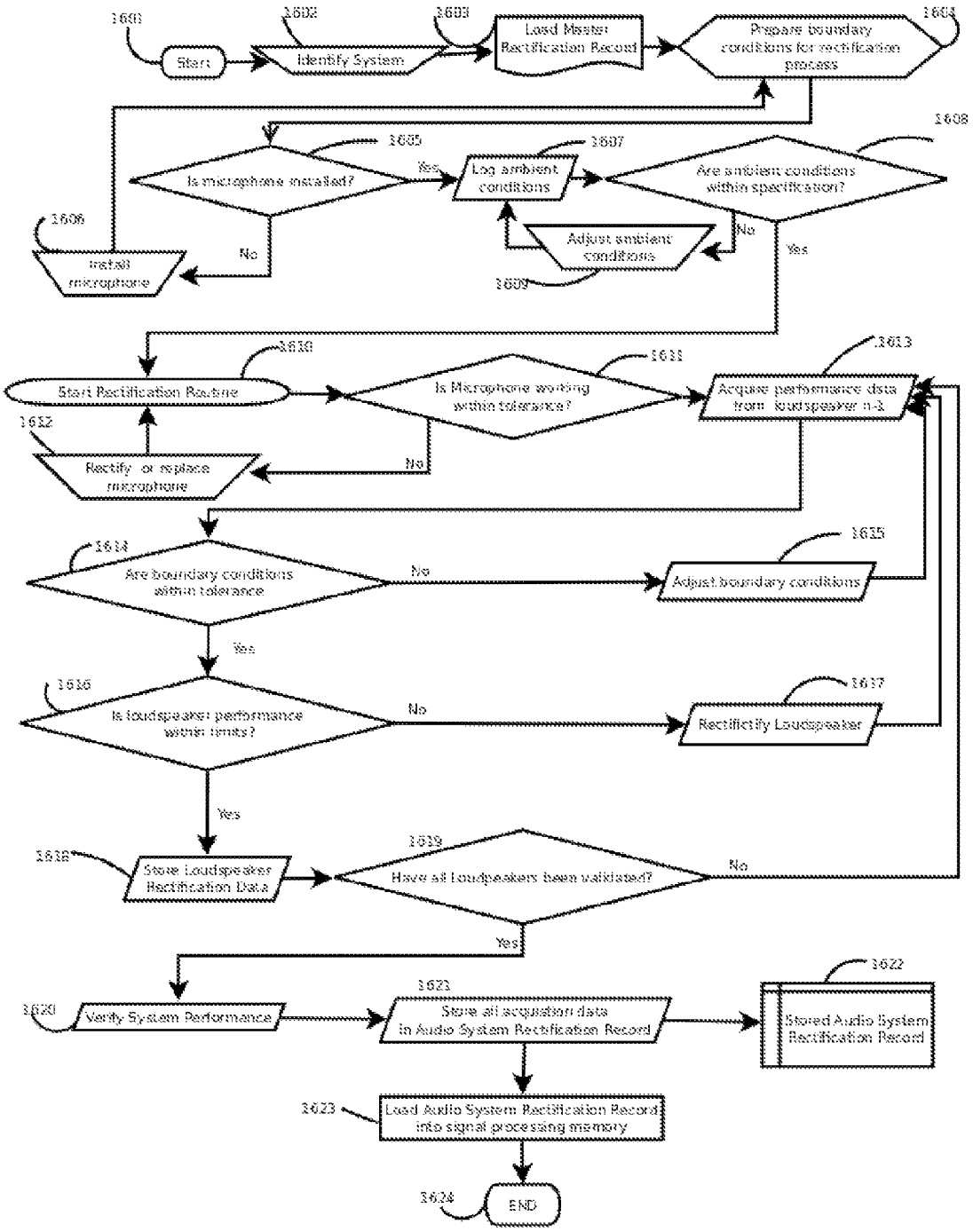
FIG. 16 illustrates the flow chart for the rectification process.

The flow chart in FIG. 16 illustrates the verification and rectification process for duplicate or production audio systems. From the start 1601 of the process the audio system should be identified 1602 preferably by VIN for vehicle audio systems then the appropriate Master Rectification Record 1514 (FIG. 15) is loaded 1603. The vehicle or acoustic space containing the audio system should be prepared for the rectification process 1604 according to the setup instructions contained in the Master Rectification Setup Record 1503 section of Master Rectification Record 1514. If the audio system does not include a microphone 1605 a microphone should be installed 1606 in compliance with setup requirements of the Master Rectification Record. Ambient conditions such as noise, temperature and humidity should be recorded and logged 1607. If ambient conditions are not within the allowable tolerance 1608 as specified in the Master Rectification Record 1514 ambient conditions should be adjusted 1609. Start the rectification routine 1610 and confirm that the microphone is working within metric thresholds tolerance 1611 and if required, rectify or replace the microphone 1612. Acquire and analyze performance data from the first loudspeaker 1613 according to the Master Rectification Record 1514 routine. If boundary conditions are not within allowable tolerance as indicated by analysis of comparison between the production loudspeaker DUT impulse response and the associated reference audio system loudspeaker DUT impulse response 1614 boundary conditions should be adjusted 1615 to match requirements as specified in the Master Rectification Record 1514. If the loudspeaker performance is not within the metrics thresholds tolerance 1616 as defined in the Master Rectification Record 1514 the loudspeaker should be rectified accordingly 1617. When the loudspeaker performs within the metrics threshold tolerance the rectification data should be stored 1618. After verifying that all loudspeakers in the audio system have been validated 1619 the full audio system may be verified 1620 and the Vehicle Rectification Record data stored 1621 preferably with a backup in a remote memory 1622 and loaded into the audio system signal processing memory 1623 as an updated signal processing record before the process terminated 1624.

The invention described in this disclosure is applicable to an audio system in any acoustic space where the methods may be applied to improving conformance between a reference audio system and a duplicated audio system such as a production audio system. The definition of vehicle as used throughout this disclosure is not limited to any one type of vehicle and is not limited to automobile, truck, train, airplane, boat or similar. The invention may apply to any acoustic space with a form where consistent boundary conditions and audio system architecture can be repeated in additional duplicate formation such as movie theaters that utilize the same architectural design and audio system.

In a first preferred embodiment of the invention a first audio system includes embedded or external or a combination of electronic hardware with signal processing and memory including processing capability required to operate an acoustic performance data acquisition, analysis and a rectification process where after final tuning of a reference audio system a signal processing record that will include but not be limited to multi-channel signal directions, crossover settings, signal delay, equalization, and limiters will be stored in an accessible file format and performance data of the reference audio system will be acquired utilizing a measurement test signal such as but not limited to a sine sweep, log-sweep, pseudorandom noise, or pink noise or cross-correlated music played through the loudspeakers and received through a measurement microphone 410 located in a documented location for example as indicated by measuring the relative distance from the microphone to fixed points in a horizontal location measurement 411 and vertical location measurement 412 such that a measurement may be repeated utilizing the same microphone location in the same or second audio system. The performance data may be acquired with all or some of the loudspeakers in the audio system operating simultaneously or more ideally with each of the loudspeakers 401 to 406 operated individually where separate data sets will be acquired and stored independently for each data acquisition. Source of the test signal may be generated during each test cycle or may be stored on any of CD, DVD, hard drive or solid state memory, or on any external memory device such as but not limited to USB drive, SD or compact flash and can be in any format such as but not limited to WAV, AU, MP3, OGG such that it may be converted to a data format that can be mathematically analyzed by a software program such as Matlab™ or Octave or similar. Relative detailed information of the test signal source, storage type, microphone information such as type and location and method will be stored with each data acquisition set. The acquisition data may be stored on a medium attached to the acquisition system directly or on a remote memory such as that attached to a remote server. The analysis of the test acquisition data may include but not be limited to frequency response and time domain analysis and an acceptable metrics threshold tolerances will be specified. Spatial attributes will be apparent in energy vs. time measurements such as an impulse response or derivatives such as energy time curve that may be captured directly in the case of a pseudorandom noise excitation or calculated by executing an Inverse Fast Fourier Transform of a swept frequency response measurement. The verification measurement process of mass production or duplicate audio systems will follow the same measurement process such that the data acquisition process utilized on the first audio system to acquire performance data metrics is also utilized on the second audio system to acquire performance data metrics. The second audio system measurement process may take place on or near a vehicle assembly production line or after completion of assembling of vehicles Signal processing data to rectify loudspeaker performance data metrics of a second audio system may be loaded into the signal processing section of an audio system via but not limited by CD, USB, WiFi, Bluetooth, directly or via a vehicle communication bus.

A second preferred embodiment of the invention uses an external computer to manage all of the signal acquisition processing required to execute the verification and rectification process.

Another preferred embodiment of the invention may use the microphone that is included in a vehicle audio system that is originally intended for communications, telephony, ambient noise characterization, active noise cancellation or similar as an acquisition microphone. Preferably the vehicle microphone has been rectified to its own metrics threshold tolerance the rectification data stored in the master rectification record. When the reference audio system has been measured through the vehicle's microphone, the production audio systems will be measured in the same manner. For accurate repeatability it is recommended that the vehicle's microphone be measured and if necessary be rectified to documented performance characteristics.

Another preferred embodiment of the invention utilizes a test signal such as but not limited to a sine sweep, log-sweep, pseudorandom noise, or pink noise sent sequentially through each loudspeaker in a reference audio system and utilizes an acquisition test microphone placed at a specific location relative to the loudspeakers and room boundaries preferably in a location that may be repeated within a 50 mm distance. In this embodiment the acquisition microphone could be mounted by measuring distances to predefined coordinates in the room or would utilize a mounting fixture for example as illustrated in FIG. 6B so that it can be placed in a specific location which in the case of a vehicle may be the rear-view mirror or a location such as instrument panel, windshield, steering wheel, proximate the apex where the windshield meets the instrument panel or a location such that in subsequent tests the same location may be accurately repeated.

Another preferred embodiment includes analysis of the boundary conditions by comparing the time domain data such as impulse response between two measurements to verify if boundary reflections as viewed in the time domain information occur in coincident or unrelated fashion.

Any of the acquisition microphone setups previously described may be connected to the test apparatus by cable or wireless transmission such as FM, UHF, Bluetooth or WiFi. Wireless transmission adds the advantage of not requiring operators to manage cables.

Variance in production loudspeakers causes duplicated audio systems to perform with wide variance and that rectifying loudspeakers to perform within a metrics threshold defined by analysis of a reference audio system is of great value. While various embodiments of the invention have been described, it will be apparent to those of ordinary skill in the art that many more embodiments and implementations are possible within the scope of the invention.

What is claimed is:

1. A method to rectify loudspeaker performance in an audio system comprising the steps of:

measuring a first set of performance data metrics with a first microphone of a first audio system that is in communication with a first processor in a first acoustic space;

generating threshold tolerances from the first set of performance data metrics in relation to boundaries in the first acoustic space;

measuring a second set of performance data metrics with a second microphone in a second audio system that is in electronic communication with a second processor in a second acoustic space in a position that duplicates the position of the first microphone in the first audio system in the first acoustic space;

comparing the second set of performance data metrics with the threshold tolerances and when the second set of performance data metrics falls outside the threshold tolerances, rectifying using electrical audio equalization a frequency response by the second set of performance data metrics by the second processor so that the second audio system is in conformance with the first set of performance data metrics; and where time domain analysis is applied to measurement of the second audio system in the second acoustic space that duplicates the first audio system in the first acoustic space to verify that the performance data metrics of the second acoustic space duplicates the first audio system in the first acoustic space and conforms to the threshold tolerances.

2. The method of claim 1, where the first and second acoustic space is a vehicle interior.

3. The method of claim 1, where the first and second acoustic space is a movie theater.

4. A method to rectify loudspeaker performance in an audio system comprising the steps of:

measuring a first set of performance data metrics with a first microphone of a first audio system that is in communication with a first processor in a first acoustic space;

generating threshold tolerances from the first set of performance data metrics in relation to boundaries in the first acoustic space;

measuring a second set of performance data metrics with a second microphone in a second audio system that is in electronic communication with a second processor in a second acoustic space in a position that duplicates the position of the first microphone in the first audio system in the first acoustic space;

comparing the second set of performance data metrics with the threshold tolerances and when the second set of performance data metrics falls outside the threshold tolerances, rectifying using electrical audio equalization a frequency response by the second set of performance data metrics by the second processor so that the second audio system is in conformance with the first set of performance data metrics; and where the first set of performance data metrics are measured sequentially on a plurality of loudspeakers in the first audio system.

5. The method of claim 1, where the second set of performance data metrics are measured sequentially on a plurality of loudspeakers in the second audio system.

6. The method of claim 1, where the step of rectifying the second set of performance data metrics may be applied to electronics in the second audio system via a communication bus.

7. The method of claim 1, where the threshold tolerances include energy vs. time domain data.

8. A method to rectify loudspeaker performance in an audio system comprising the steps of:

measuring a first set of performance data metrics with a first microphone of a first audio system that is in communication with a first processor in a first acoustic space;

generating threshold tolerances from the first set of performance data metrics in relation to boundaries in the first acoustic space;

measuring a second set of performance data metrics with a second microphone in a second audio system that is in electronic communication with a second processor in a second acoustic space in a position that duplicates the position of the first microphone in the first audio system in the first acoustic space; and comparing the second set of performance data metrics with the threshold tolerances and when the second set of performance data metrics falls outside the threshold tolerances, rectifying using electrical audio equalization a frequency response by the second set of performance data metrics by the second processor so that the second audio system is in conformance with the first set of performance data metrics; and where the second acoustic space is measured by a computer.

9. The method of claim 8, where the vehicle diagnostic computer used to measure the second acoustic space is a computer external to the vehicle.

10. The method of claim 8, where the vehicle diagnostic computer used to measure the second acoustic space is embedded in the vehicle's audio system electronics.

11. A method to rectify loudspeaker performance in an audio system comprising the steps of: measuring a first set of performance data metrics with a first microphone of a first audio system that is in communication with a first processor in a first acoustic space; generating threshold tolerances from the first set of performance data metrics in relation to boundaries in the first acoustic space; measuring a second set of performance data metrics with a second microphone in a second audio system that is in electronic communication with a second processor in a second acoustic space in a position that duplicates the position of the first microphone in the first audio system in the first acoustic space; comparing the second set of performance data metrics with the threshold tolerances and when the second set of performance data metrics falls outside the threshold tolerances, rectifying using electrical audio equalization a frequency response by the second set of performance data metrics by the second processor so that the second audio system is in conformance with the first set of performance data metrics; and where a comparison of the second performance data metrics in the first audio system to the threshold tolerances is stored in a measurement setup file.

12. The method of claim 11, where the ambient environmental conditions are acquired by sensors installed in a vehicle and stored in the measurement setup file.

13. A method to rectify loudspeaker performance in an audio system comprising the steps of:

measuring a first set of performance data metrics with a first microphone of a first audio system that is in communication with a first processor in a first acoustic space;

generating threshold tolerances from the first set of performance data metrics in relation to boundaries in the first acoustic space;

measuring a second set of performance data metrics with a second microphone in a second audio system that is in electronic communication with a second processor in a second acoustic space in a position that duplicates the position of the first microphone in the first audio system in the first acoustic space;

comparing the second set of performance data metrics with the threshold tolerances and when the second set of performance data metrics falls outside the threshold tolerances, rectifying using electrical audio equalization a frequency response by the second set of performance data metrics by the second processor so that the second audio system is in conformance with the first set of performance data metrics; and where the first microphone is placed in a position proximate to a first loudspeaker and boundaries of the first audio system for a first data acquisition of the first performance data metrics are stored in a measurement setup file and the second microphone is placed in a position proximate to a second loudspeaker and boundaries of the second audio system and replicates the first microphone's location coordinates so that a second data acquisition of the second performance metrics conform to the measurement setup file.

14. A method to rectify loudspeaker performance in an audio system comprising the steps of: measuring a first set of performance data metrics with a first microphone of a first audio system that is in communication with a first processor in a first acoustic space; generating threshold tolerances from the first set of performance data metrics in relation to boundaries in the first acoustic space; measuring a second set of performance data metrics with a second microphone in a second audio system that is in electronic communication with a second processor in a second acoustic space in a position that duplicates the position of the first microphone in the first audio system in the first acoustic space; comparing the second set of performance data metrics with the threshold tolerances and when the second set of performance data metrics falls outside the threshold tolerances, rectifying using electrical audio equalization a frequency response by the second set of performance data metrics by the second processor so that the second audio system is in conformance with the first set of performance data metrics; and including environmental conditions during the step of measuring the second audio system in the second acoustic space are compared to ambient environmental conditions during the step of measuring the first audio system in the first acoustic space where the ambient environmental conditions are adjusted for conformity.

15. A method to rectify loudspeaker performance in an audio system comprising the steps of: measuring a first set of performance data metrics with a first microphone of a first audio system that is in communication with a first processor in a first acoustic space; generating threshold tolerances from the first set of performance data metrics in relation to boundaries in the first acoustic space; measuring a second set of performance data metrics with a second microphone in a second audio system that is in electronic communication with a second processor in a second acoustic space in a position that duplicates the position of the first microphone in the first audio system in the first acoustic space; comparing the second set of performance data metrics with the threshold tolerances and when the second set of performance data metrics falls outside the threshold tolerances, rectifying using electrical audio equalization a frequency response by the second set of performance data metrics by the second processor so that the second audio system is in conformance with the first set of performance data metrics; and where the second microphone utilized for acquiring the second performance data metrics is part of a vehicle electronics system.

16. A method to rectify loudspeaker performance in an audio system comprising the steps of:

measuring a first set of performance data metrics with a first microphone of a first audio system that is in communication with a first processor in a first acoustic space;

generating threshold tolerances from the first set of performance data metrics in relation to boundaries in the first acoustic space; measuring a second set of performance data metrics with a second microphone in a second audio system that is in electronic communication with a second processor in a second acoustic space in a position that duplicates the position of the first microphone in the first audio system in the first acoustic space;

comparing the second set of performance data metrics with the threshold tolerances and when the second set of performance data metrics falls outside the threshold tolerances, rectifying using electrical audio equalization a frequency response by the second set of performance data metrics by the second processor so that the second audio system is in conformance with the first set of performance data metrics;

where the first set of performance data metrics include boundary reflection analysis of the first audio system in the first acoustic space and a comparison is made to boundary reflections analysis of the second audio system in the second acoustic space; and when the difference between the second set of performance data metrics and the first set of performance data metrics is greater than the threshold tolerances, the boundary conditions in the second acoustic space are rectified to be in conformance with the first set of performance data metrics.

17. A method to rectify loudspeaker performance in an audio system comprising the steps of:

measuring a first set of performance data metrics with a first microphone of a first audio system that is in communication with a first processor in a first acoustic space;

generating threshold tolerances from the first set of performance data metrics in relation to boundaries in the first acoustic space;

measuring a second set of performance data metrics with a second microphone in a second audio system that is in electronic communication with a second processor in a second acoustic space in a position that duplicates the position of the first microphone in the first audio system in the first acoustic space; comparing the second set of performance data metrics with the threshold tolerances and when the second set of performance data metrics falls outside the threshold tolerances, rectifying using electrical audio equalization a frequency response by the second set of performance data metrics by the second processor so that the second audio system is in conformance with the first set of performance data metrics; and where the step of rectifying the second set of performance data metrics where signal processing is applied to the second audio system to reduce the second performance data metrics differences with the threshold tolerances.

18. The method of claim 17, where the step of rectifying the second set of performance data metrics signal processing may be applied to electronics in the second audio system via wireless communication.

19. The method of claim 17, where the first microphone utilized for acquiring the first performance data metrics is part of a vehicle electronics system.

20. The method of claim 17, where the first and second acoustic space is a vehicle interior.

21. The method of claim 17, where the first and second acoustic space is a movie theater.

* * * * *